United States Patent [19]

Yasuda et al.

[11] 4,163,224

[45] Jul. 31, 1979

[54] DISPLAY DEVICE WITH MEMORY

[75] Inventors: Katsuya Yasuda, Yokohama; Akio Adachi, Machida, both of Japan

[73] Assignee: Hochiki Corporation, Tokyo, Japan

[21] Appl. No.: 772,338

[22] Filed: Feb. 25, 1977

[30] Foreign Application Priority Data

Feb. 27, 1976 [JP] Japan ..... 51-020951

[51] Int. Cl.[2] ..... G08B 25/00

[52] U.S. Cl. ..... 340/520; 340/286 M

[58] Field of Search ..... 340/225, 415, 324 R, 340/286 M, 520

[56] References Cited

U.S. PATENT DOCUMENTS

| | | | |
|---|---|---|---|
| 3,767,851 | 10/1973 | Wick | 340/225 |
| 3,806,907 | 4/1974 | Bound et al. | 340/225 |
| 3,855,456 | 12/1974 | Summers et al. | 340/415 |
| 3,965,469 | 6/1976 | Ryan | 340/415 |

*Primary Examiner*—Marshall M. Curtis

*Attorney, Agent, or Firm*—Wenderoth, Lind & Ponack

[57] ABSTRACT

The present invention is a display device with a memory which stores the order of reception of actuating signals from a plurality of terminal units. When one of the terminal units produces a signal a first counter causes the outputs of all the terminal units to be scanned. Each terminal unit is connected to a resettable one shot circuit which is scanned under the control of the first counter. When the signaling terminal unit is scanned, the resettable one shot is triggered to advance the count of a second counter. Then the number in the first counter, which corresponds to the specific signaling terminal unit, is stored in one of a plurality of memory means which corresponds to the order of reception stored in the second counter. The resettable one shot circuits prevent the number of a specific terminal unit from being stored in a second memory means due to a continued or repeated signal. The numbers stored in the memory means may be recalled and displayed together with the order of reception with the aid of a manually controlled third counter which selects the memory means to drive a display.

1 Claim, 9 Drawing Figures

FIG. 4a
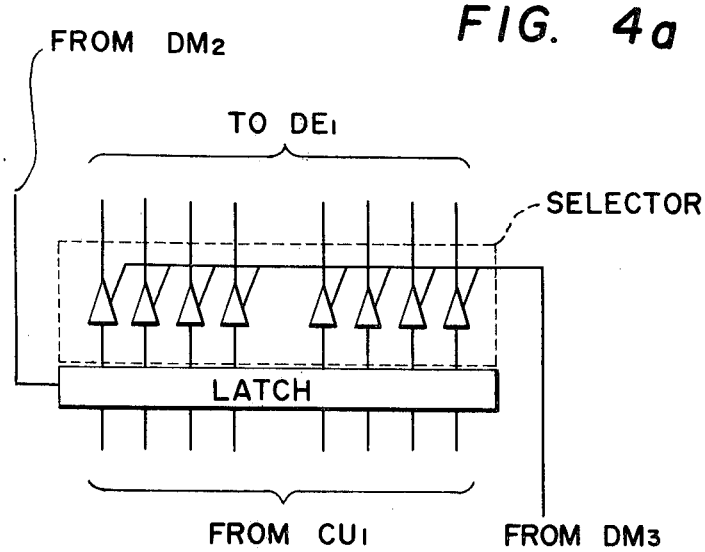
FIG. 4b
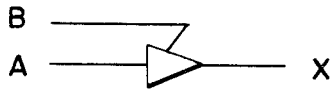
FIG. 4c
TRUTH TABLE
| A | B | X |
|---|---|---|
| 1 | 0 | H·I ( HIGH I MP. OFF) |
| 0 | 0 | H·I ( " ) |
| 1 | 1 | 1 |
| 0 | 1 | 0 |
FIG. 6
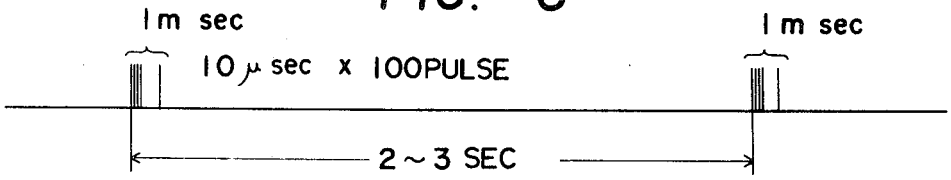

DISPLAY DEVICE WITH MEMORY

BACKGROUND OF THE INVENTION

This invention relates to a display device with a memory which is connected to a large number of terminal units to for storing an indication of the actuating signals produced from the terminal units upon the actuation of the units in the order of their actuation and then for displaying the reference number of the terminal units thus actuated in the order of their actuation.

In the case, for example, of a fire warning system incorporating a great many fire sensors as the terminal units, since the conventional system employs display units for indicating the actuation of every terminal unit in a central display device, the central display device must be large in size and have a primitive display function. In addition, the conventional random display function of the display device is disordered compared with the display device improved according to this invention which can display the information in the order of reception of the information from a large number of terminal units and which can also repeatedly display the information in the received order to dynamically display the actuating conditions of the information supplied from the terminal units.

In case environmental changes in a certain restricted planar region or three-dimensional space are detected by the terminal units collectively provided therein, it is not necessary to provide the same number of display units as terminal units to display the actuation of the terminal units. This is because the status of the environmental changes which take place thereafter are desirably observed in relation to the place where the changes first occurred and can be accurately appreciated by observing the direction of movement of the changes in comparison with the spatial placement of the actuated terminal units. The amount of the information becomes extremely small when the information is grasped linearly with respect to the lapse of time as compared with the case in which the information is grasped spatially.

SUMMARY OF THE INVENTION

It is an object of the invention to provide a display device with a memory which may store an indication of the actuating signals from a large number of terminal units in the order of reception and which also may display the representation of the terminal units which produced the signals in the order of their reception.

It is another object of the invention to provide a display device with a memory which may repeatedly display an indication of the terminal units producing actuating signals which are received and then cease even after the connecting lines between the terminal units and the display device are broken, in the order of reception.

Since a fire warning system installed in a building accommodates a large number of terminal units such as alarms and sensors at many positions on respective floors, it is preferable for the display device of the central control apparatus installed in a control chamber of the building to display the representations of the actuated or operated terminal units in the sequence of actuation or operation.

The actuating signal produced from a certain terminal unit or units is received by a scanning circuit from any of lines connecting the terminal units to the circuit, and all the lines are scanned by the scanning circuit every time an actuating signal is received from any of the terminal units by the scanning circuit, so as to determine the terminal unit thus actuated or the line connected to the actuated terminal unit. If a clock pulse having a pulse width of 0.01 msec. is employed for the scanning operation of the scanning circuit, the actuated terminal unit can be determined from 100,000 terminal units or the lines connected to the terminal units in the case of a scanning period of one second. A scanning period of one second is sufficient to allow grasping or judging the direction of the spreading fire. The normal number of lines connected to the terminal units is approximately 100 lines, and accordingly the scanning time of this system may be 1 msec. if the aforementioned scanning rate employed.

According to this invention, there is provided counter operated by clock pulses which enables the display of the representation of the terminal units or the representation of the lines connected to the terminal units. These identified by integer numbers 0, 1, 2 . . . n. More particularly, when the counter indicates "n", it means that an actuating signal has been received from the nth terminal unit or line upon scanning of the terminal units or lines by the scanning circuit.

Furthermore, the actuating signal delivered to the scanning circuit from the counter is simultaneously fed to a latch circuit which stores the numerical information when the output from the scanning circuit is applied to the latch terminal.

One output of the scanning circuit is produced for every scanning operation of the circuit. A great many latch circuits connected to the aforesaid counter are latched successively one by one each time the scanning circuit produces an output to be applied to the latch circuits. Thus, a large number of latch circuits hold the reference numbers of the terminal units or lines actuated in the order of reception of the actuating signals from the terminal units or the lines connected to the units. If it is desired to display an indication of the actuated terminal unit or the line connected to the terminal unit, numerical information which designates the actuated terminal unit or the line connected thereto can be supplied successively from the latch circuit to the display unit in such a manner that any this displaying operation may be executed without disturbing the scanning operation of the scanning circuit. The number of latch circuits required depends upon the number required for determining the direction of motion of the positions of the or the lines connected thereto, i.e., the direction of the spreading fire for example. In case, for example, 100 terminal units are employed connected to the scanning circuit via the lines for displaying 100 positions of the actuating units under the control of the display device, and exemplified by the embodiment as will hereinafter described in greater detail, the current consumption of the display system is limited to only 7 mA when no alarm signal is generated and becomes 200 mA when the system is activated by an alarm signal. Accordingly the display device with a memory constructed according to this invention can be operated by a battery.

Moreover, according to another aspect of the display device with a memory of this invention constructed with a built-in power source for automatically switching to ON for the display device upon actuation of any terminal unit, even if the lines connected between the terminal units and the display device are broken during the spreading fire, the information stored in the latch circuit can be preserved by the memory so as to examine the position of the initial fire and the path of the spreading fire after the extenguishment of the fire.

BRIEF DESCRIPTION OF THE DRAWINGS

FIG. 4*a* is an electric circuit diagram of a preferred example of a selector circuit;

FIG. 4*b* is schematic view of the tri-state buffer element used in the selector circuit shown in FIG. 4*a;*

FIG. 4*c* is a truth table showing the operational conditions of the tri-state buffer element shown in FIG. 4*a;*

FIG. 5*b* is a time chart of the input and output signal wave shapes of the wave shaping circuit shown in FIG. 5*a;* and FIG. 6 is a time chart showing an operating example of the scanning circuit in the display device of this invention.

DESCRIPTION OF THE PREFERRED EMBODIMENTS

Figure 1:
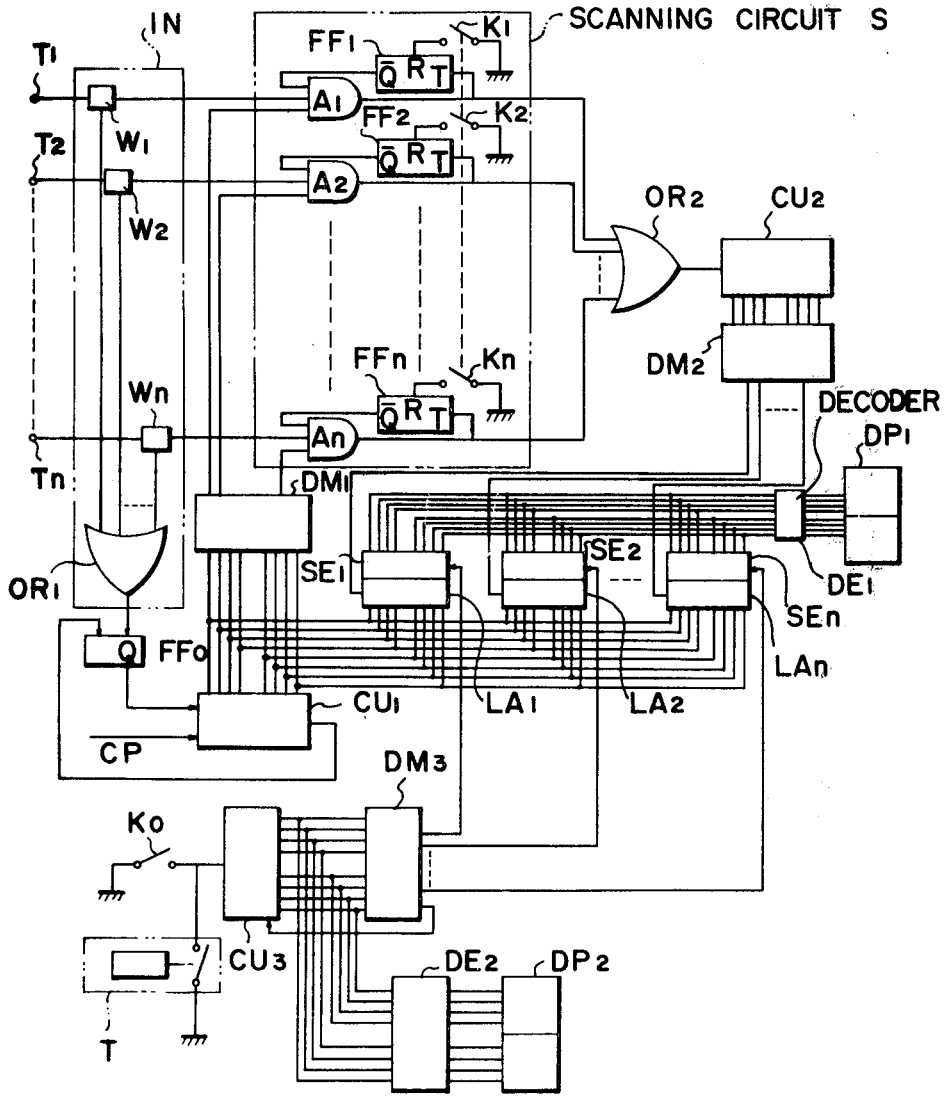
FIG. 1 is an electric circuit diagram of a display device with a memory constructed according to a preferred embodiment of this invention.

FIG. 1 illustrates one preferred embodiment of the display device with a memory constructed according to this invention. Terminal $t_1$ through $t_n$ constitute plural input terminals connected with the terminal units such as sensors. An input section IN has wave shaping circuits $W_1$ through $W_n$ for shaping the waveforms of the signals applied to the input terminals $t_1$ through $t_n$ to transform them into determined pulse shapes and an OR gate circuit $OR_1$ for receiving the outputs of the wave shaping circuits $W_1$ through $W_n$ thereof. A scanning circuit S is connected to an OR gate $OR_2$ circuit which receives the outputs of the scanning circuit S thereof. A first counter $CU_1$ counts the clock pulses CP. Flip flop FFo is set upon receipt of the output of the OR gate circuit $OR_1$ and is reset upon receipt of the overflow pulse from the first counter $CU_1$ and controls the counting operation of the first counter $CU_1$ by the output Q thereof. First decoder matrix $DM_1$ serves to decode the counted content of the first counter $CU_1$ to produce a scanning signal output to be applied to the scanning circuit S. A second counter $CU_2$ counts the outputs from the OR gate circuit $OR_2$. A second decoder matrix $DM_2$ decodes the counted content of the second counter $CU_2$. Latch circuits $LA_1$ to $LA_n$ read the counted content of the first counter $CU_1$ upon receipt of the decoded output from the second decoder matrix $DM_2$ as a latch pulse. For example, the latch pulse "1" is applied to the latch circuit $LA_1$ from the decoder matrix $DM_2$ when the counted value of the counter $CU_2$ is "1", the latch pulse "2" is applied to the latch circuit $LA_2$ when the counted value of the counter $CU_2$ is "2", . . . , the latch pulse "n" is applied to the latch circuit $LA_n$ when the counted value of the counter $CU_n$ is "n". Selectors $SE_1$ through $SE_n$ are connected to the output terminals of the latch circuits $LA_1$ through $LA_n$, respectively. A first 7-segment decoder $DE_1$ the stored contents of the latch circuits $LA_1$ through $LA_n$ via the respective selectors $SE_1$ through $SE_n$. A first 7-segment display unit $DP_1$ displays the number from $DE_1$. Alternation command switch Ko causes alternation of the display content. A third counter $CU_3$ counts the number of actuations of the command switch. A third decoder matrix $DM_3$ decodes the counted content of the third counter $CU_3$ to produce control signals for the respective selectors $SE_1$ through $SE_n$. A second 7-segment decoder $DE_2$ decodes the counted content of the third counter $CU_3$ to produce an output signal to be applied to the second 7-segment display unit $DP_2$.

The third decoder matrix $DM_3$ serves to select one of the latch circuits $LA_1$ through $LA_n$ corresponding to the counted value of the counter $CU_3$ in such a manner that the output of the latch circuit $LA_{n+1}$ is applied to the third counter $CU_3$ as its reset signal. These selectors $SE_1$ through $SE_n$, decoder matrix $DM_3$, counter $CU_3$, switch Ko and a circuit T, which will hereinafter be described in greater detail, form a display command circuit.

As will be hereinbelow described in greater detail, the reference numbers of the actuated terminal units are stored in the latch circuits $LA_1$ through $LA_n$ in the order of their actuation. Accordingly, the counted value of the counter $CU_3$ which designates one of the latch circuits $LA_1$ through $LA_n$ indicates the sequential order of the actuated terminal units and is displayed by the second display unit $DP_2$. The first display unit $DP_1$ serves to display the numbers of the actuated terminal units.

The scanning circuit S has AND gate circuits $A_1$ through $A_n$, flip-flops $FF_1$ through $FF_n$, and reset switches $K_1$ through $K_n$. An actuating signal received from one terminal unit one the input terminal $t_1$ is delivered to the first input of the AND gate circuit $A_1$ via the wave shaping circuit $W_1$ and is also delivered to the first counter $CU_1$ via the wave shaping circuit $W_1$, the OR gate circuit $OR_1$ and the flip-flop FFo. This causes the counter $CU_1$ to count one, which is applied to the first decoder matrix $DM_1$ to cause the matrix $DM_1$ to decode the counted content "1" from the counter $CU_1$ to produce a scanning signal "1", which is applied to the second input of the AND gate circuit $A_1$ in the scanning circuit S. If the reset switch $K_1$ is closed, the flip-flop $FF_1$ is reset to produce a reset signal "1" from its reset output terminal Q. This signal "1" is applied to the third input of the AND gate circuit $A_1$. Thus, the AND gate circuit $A_1$ applies an output a signal "1" to one input of the OR gate circuit $OR_2$ and also to the set input T of the flip-flop $FF_1$ to cause the flip-flop $FF_1$ to produce a low level reset signal "0" from its reset output terminal Q. This low level reset signal is applied to the second input of the AND gate circuit $A_1$ to cause the AND gate circuit $A_1$ to apply no output signal to the input of the OR gate circuit $OR_2$. Thus, the AND gate circuit $A_1$ produces no output signal until the reset switch $K_1$ is opened after the fire is extinguished or the cause of the fire is known, to prevent the same fire alarm from being again applied to the latch circuit $LA_1$ via the second counter $CU_2$ and the second decoder matrix $DM_2$ which decodes the counted contents of the second counter $CU_2$.

If a circuit T for opening and opening a contact at a predetermined time such as a timer is connected instead of or in parallel with the manual alternation command switch Ko in order to cause the display alternation of the display units $DP_1$ and $DP_2$, the display may be automatically altered at predetermined times. The content of the display need not always be numerical but may also be characters such as the letters of the alphabet displayed by means of a flapper display unit or the like. In this case the decoder $DE_1$ and the like should be replaced with an appropriate decoder circuit.

Figure 3:
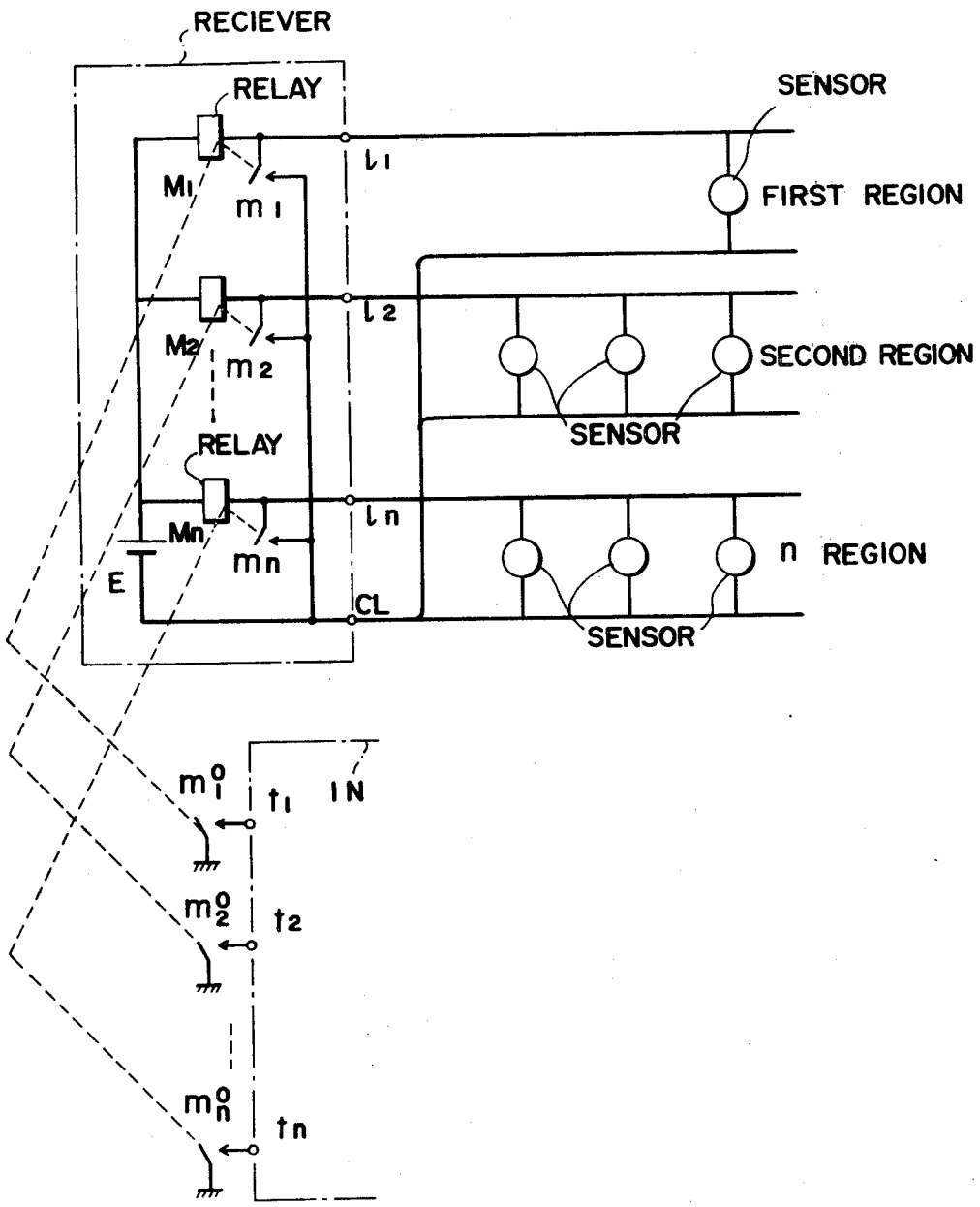
FIG. 3 is an electric circuit diagram of a preferred example of the connecting lines between the display units and the terminal units.

Referring to FIG. 3, which shows one preferred example of the connecting lines of the actuating signal from the terminal units to the display units, the sensors of the terminal units may, for example, include ionization smoke detectors, photoelectric smoke detectors, rate-of-rise heat detectors, fixed temperature heat detectors, and the like. Manual call boxes, and the like may also be adopted as the terminal units. These terminal units may be selected from any of the above described sensors or detectors depending upon the conditions of the respective observation regions as partitioned into first to n-th regions.

These connecting lines $l_1$ through $l_n$ have respective relays $M_1$ through $M_n$ in the receiver circuit for closing relay contacts $m_1$ through $m_n$ for self-holding the relays and relay contacts $m_1^o$ through $m_n^o$ connected to the respective input lines connected to the input terminals $t_1$ through $t_n$ of the display device.

The operation of the display device with the memory thus constructed will now be described in detail.

If one actuating signal is, for example, applied from one terminal unit to one terminal t, this signal is shaped through the wave shaping circuit $W_1$ in the input section IN to a predetermined pulse shape, which is applied to one input of the OR gate circuit $OR_1$ and which is also delivered to the first input of the AND gate circuit $A_1$ in the scanning circuit S. The OR gate circuit $OR_1$ produces an output signal, which is applied the set input of the flip-flop $FF_o$ to cause the flip-flop $FF_o$ to produce a high level output Q. This is delivered to the first counter $CU_1$ to cause the counter $CU_1$ to be released by this reset input. As a result, the counter $CU_1$ starts to count the clock pulses CP applied to its other input. Then, the counter $CU_1$ produces a binary output, which is fed to the first decoder matrix $DM_1$ and which is also delivered to the respective latch circuits $LA_1$ through $LA_n$.

The decoder matrix $DM_1$ serves to decode the counted content "1" of the first counter $CU_1$ to produce a scanning signal output to sequentially provide a high level signal "1" from the first to the n-th output terminals thereof. These are applied to the scanning circuit S in such a manner that the first high level signal "1" from the first output terminal is applied to the second input of the AND gate circuit $A_1$, the second high level signal "1" to the AND gate circuit $A_2, \ldots$, the n-th high level signal "1" to the AND gate circuit $A_n$ to cause the AND gates $A_1$ through $A_n$ to be successively scanned. Thus, if the high level of the first output terminal of the decoder matrix $DM_1$ is applied to the second input of the AND gate circuit $A_1$, the AND gate circuit $A_1$ will produce a high level output signal since an actuating signal is applied to the input terminal $t_1$ via the wave shaping circuit $W_1$ to the first input of the AND gate circuit $A_1$ and the high level reset signal Q of the flip-flop $FF_1$ is applied to the third input of the AND gate circuit $A_1$. This output signal of AND gate circuit $A_1$ is applied via one input of the OR gate circuit $OR_2$ to the second counter $CU_2$ to cause the counter $CU_2$ to count "1". Simultaneously, the high level output signal is applied to the set input T of the flip-flop $FF_1$ to cause the flip-flop $FF_1$ to produce low level signal "0" at the reset output Q thereof thus to cause the AND gate circuit $A_1$ to produce a low level output. As a result, the AND gate circuit $A_1$ does not conduct until the reset switch $K_1$ is manually opened after the fire is extinguished. Then, any of the actuating signals from the input terminals $t_2$ through $t_n$ may be similarly applied to the counter $CU_1$ to cause the counter $CU_1$ to produce a new binary output. This new binary output is applied to the scanning circuit S, however the input terminal $t_1$ is not scanned to prevent the application of the counted input to the second counter $CU_2$.

If the second counter $CU_2$ is incremented upon scanning of the initial actuating signal as has been described, the counted output, i.e., the binary output "1" from the counter $CU_2$ is decoded by the second decoder matrix $DM_2$ which causes the matrix $DM_2$ to produce a high level output "1" at the first output terminal thereof. This high level is applied to the latch circuit $LA_1$. Consequently, the latch circuit $LA_1$ serves to read the counted value "1" of the first counter $CU_1$.

In case the only actuating signal is the one applied to the input terminal $t_1$, the number "1" of the actuating signal from the first terminal unit is merely written into the latch circuit $LA_1$. However, in case, for example, that two additional actuating signals are applied to the input terminals $t_2$ and $t_n$, the following operation takes place in addition to the aforementioned operation.

The AND gate circuits $A_2$ and $A_n$ also produce respective high level output signals when the clock pulses CP causes counter $CU_1$ to count two and n, causing the decoder matrix $DM_1$ to select the AND gate circuits $A_2$ and $A_n$. Then, the counter $CU_2$ also serves to count "2", and then "3", when the AND gate circuit $A_2$ is scanned causing the counter $CU_2$ to count "2", the latch circuit $LA_2$ is selected to read the counted value "2" stored in the counter $CU_1$. Thereafter, the AND gate circuit $A_n$ is then scanned, the latch circuit $LA_3$ (not shown) is selected when the counter $CU_2$ counts the counted value "3", to thus read the counted value "n" of the counter $CU_1$. Thus, the respective numbers of the terminal units producing actuating signals are on the latch circuits $LA_1$ through $LA_n$ in the order of the sequential actuation of the terminal units.

The display of the actuated terminals will be conducted as follows:

If the switch Ko is once closed and opened, the counter $CU_3$ acts to count the value "1". This counted value "1" is applied to the second display unit $DP_2$ to represent the "first" terminal unit in sequence to produce an actuated signal and is also applied to the third decoder matrix $DM_3$. The matrix $DM_3$ decode the counted value of the third counter $CU_3$ and selects the selector $SE_1$ which accordingly delivers the counted output "1" of the first counter $CU_1$ read by the latch circuit $LA_1$ to the first 7-segment decoder $DE_1$ causing the decoder $DE_1$ to display the counted value "1" by the first display unit $DP_1$. Thus, the display units $DP_1$ and $DP_2$ display the fact that the first actuating signal was produced by the first terminal unit.

If the switch Ko is once again closed and opened, the counter $CU_3$ acts to count the value "2". This is similarly applied to the second display unit $DP_2$ which thus displays the counted value "2". Then, the latch circuit $LA_2$ is selected to thus display the counted value "2" written into the latch circuit $LA_2$ by the first display unit $DP_1$. Further, if the switch Ko is additionally closed and opened another time, then the counter $CU_3$ counts the value "3", which is similarly applied to the second display unit $DP_2$ and the latch circuit $LA_3$ is selected to thus display the value "n" stored in latch circuit $LA_3$ by the first display unit $DP_1$. Similarly, when the switch Ko is repeatedly closed and opened n times, the second display unit $DP_2$ displays the value "n" and the first display displays the counted value stored in latch circuit $LA_n$ in the same manner as above.

Figure 2:
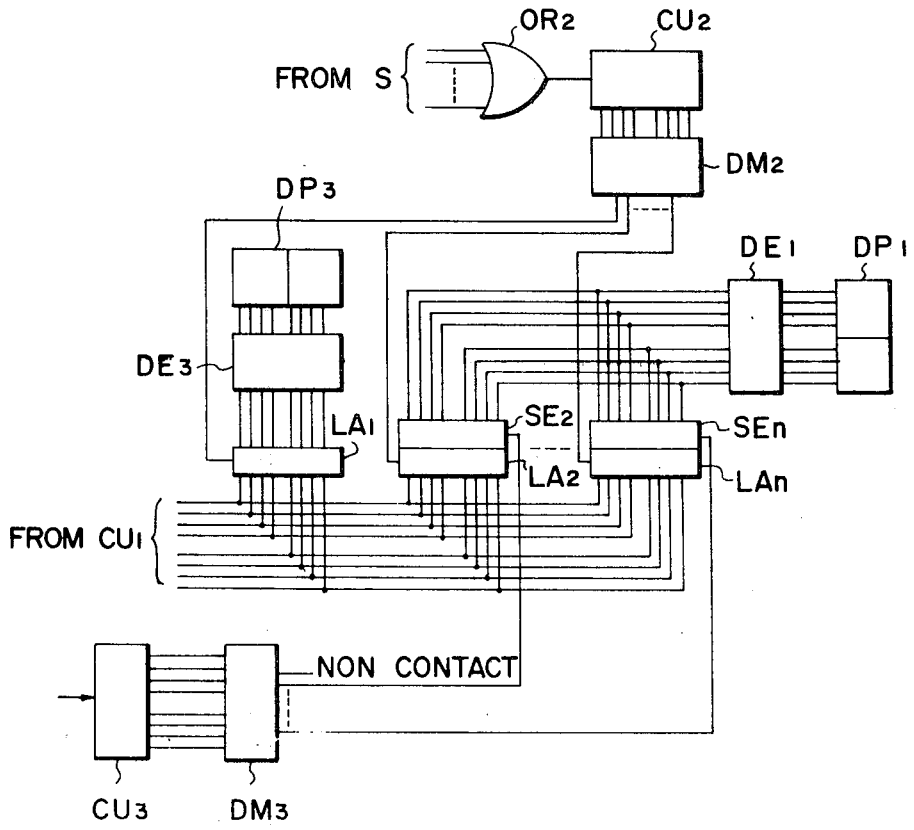
FIG. 2 is a partial electric circuit diagram of the display device having a display unit together with an additional display unit.

Referring now to FIG. 2, which shows another preferred embodiment of the display device with a memory constructed according to this invention, although two display units are employed, one for displaying the content or number of the actuated terminal unit and another for displaying the order of the actuated terminal units to thus sequentially displaying the conditions of the respective terminal units in the embodiment shown in FIG. 1, there is provided an additional display unit $DP_3$ specifically for displaying, for example, the first actuated terminal unit together with the latch circuit $LA_1$ and the first 7-segment decoder $DE_3$ also specifically for the first actuated unit. In this case, the selector of the latch circuit $LA_1$ is omitted, or the first latch circuit $LA_1$ is always operating. Thus, the number of the first actuated terminal unit producing the first actuating signal to any of the input terminals $t_1$ through $t_n$ is displayed by the specified display unit $DP_3$. Then, the second and later reference numbers of the second and later actuated terminal units are stored in the latch circuits $LA_2$ to $LA_n$ to sequentially display the order of actuated terminal units by the display unit $DP_1$ by manipulating the switch Ko as desired.

If this arrangement of the display device is applied to a fire alarm or the like, the first warning signal is at first directly displayed upon occurrence of a fire. The second and later warning signals for the spreading fire are stored in the latch circuits and may be sequentially displayed in the order of actuation of the terminal units by the second display unit by the actuations of the switch Ko enabling the details of the spread of the fire to be displayed on a small display device according to the priority of emergency.

It is to be noted that although there is only one specified display unit in the embodiment of the display device with the memory shown in FIG. 2 several specified display units such as five may be provided to directly display the occurrence of fires, and the sixth and later warning signals for the spreading fire maybe stored in the latch circuits to sequentially display the spread of the fire on small display device in the order of actuation of terminal units by the second display unit.

It should be understood from the foregoing description that since the display device with a memory is thus constructed and operated according to this invention, a large number of actuating signals from a great many terminal units such as fire sensors together with the order of actuation of the terminal units can be accurately displayed on a small displaying area having fewer display units. In addition, it should also be understood that the displays can be simply changed by the push-button switch or periodical signals. Accordingly, the construction of the display device of this invention can be made very compact so as to conserve space by occupying a small area and also to provide larger display units because fewer display units are employed to ease the observation of the conditions displayed on the display units. Further, it should also be understood that since one or more specified display units can be provided in addition to the display unit $DP_1$ which cooperates with the latch circuit, the reference numbers of the first and following several actuated terminal units can be immediately displayed directly on the specified display units and the numbers of other following actuated terminal units can be stored in the latch circuits for sequential display on the first display unit $DP_1$ corresponding to the types and requirements of the usage.

The circuit shown in FIG. 4*a* is one preferred example of the selector circuit used in the display device with a memory of this invention. When the tri-state buffer elements shown in FIG. 4*b* receive an output from the decoder matrix $DM_3$ at the control terminals B thereof, the outputs from the latch circuits applied to the input terminals A of the tri-state buffer elements are produced from the output terminals X of the buffer elements. The operating conditions of the three respective terminals of the tri-state buffer elements are as designated in the truth table of FIG. 4*c*.

Figure 5A:
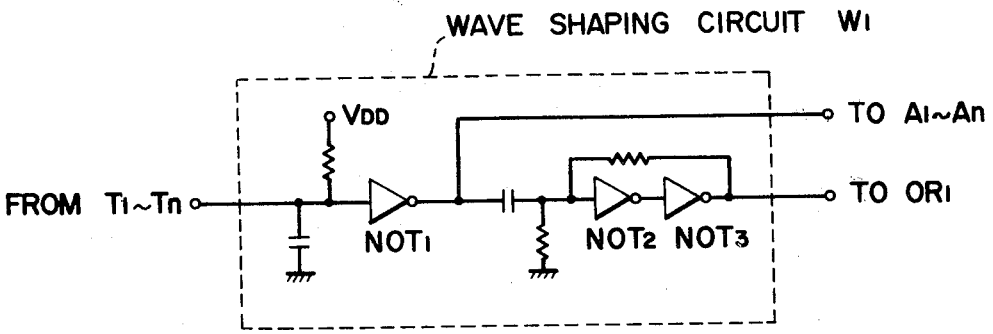
FIG. 5*a* is an electric circuit diagram of one preferred example of the wave shaping circuit.
Figure 5B:
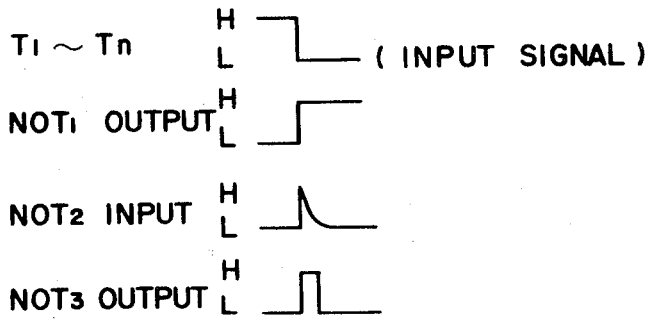

The circuit shown in FIG. 5*a* is one preferred example of the wave shaping circuits $W_1$ through $W_n$, and can be operated by a supply voltage $V_{DD}$ of 5 to 15 volts. When one of the relay contacts $m_1^o$ through $m_n^o$ of the respective relays $M_1$ through $M_n$ shown in FIG. 3 are operated, the input signal received by the corresponding input terminal $t_1$ through $t_n$ is illustrated in FIG. 5*b*. If the relay contacts are closed, these input terminals are grounded to attain a low level.

An inverter circuit $NOT_1$ serves to produce a high level $NOT_1$ output signal as shown in FIG. 5*b* upon receipt of the input signals applied to the input terminals $t_1$ through $t_n$. The output from the gate circuit $NOT_1$ is applied to one input of the AND inverter circuits $A_1$ through $A_n$. In the meanwhile, an inverter circuit $NOT_2$ receives the output from the inverter circuit $NOT_1$ to produce an output, which is applied to the input of an inverter circuit $NOT_3$ to cause the inverter circuit $NOT_3$ to produce the output shown in FIG. 5*b*, which is applied to one input of the OR gate circuit $OR_1$.

The wave shaping circuit $W_1$ thus arranged is employed in the display device of this invention, and thus a continuous signal is applied to the scanning circuit S and a pulse signal is applied to the OR gate circuit $OR_1$ for starting the counter $CU_1$.

It is to be noted that the wave shaping circuit adopted may be any of the conventional circuits, such as the first example shown in FIG. 1 or the second example shown in FIG. 5*a*, depending upon the configuration of the actuating signal applied to the terminals $t_1$ through $t_n$.

The time chart shown in FIG. 6 illustrates the relationship between the intervals of the actuating signals produced from the terminal units and the scanning time of the scanning circuit S in an actual case, from which it will be understood that almost no actuating signal initiations occur during the scanning time of the scanning circuit S. This time chart shows an example of the case in which 100 scanning operations are achieved by the scanning circuit S with clock pulses of $10\mu$ sec. in time duration. The scanning time in this case is 1 msec. The intervals between the successive actuating signals produced from the terminal units in this example is 2 to 3 seconds from the time the fire takes place to the time the fire spreads to the adjacent terminal units and may be as long as as 5 seconds. This interval may be altered by the pattern of arrangement and locations of the terminal units such as fire sensors and the dispositions of the lines connecting the respective terminal units to the display device with a memory.

What is claimed is:

1. A display device with a memory comprising:

a plurality of terminal units, each for measuring a physical parameter and producing a signal when the physical parameter exceeds a predetermined limit;

a first OR means connected to said plurality of terminal units for producing a signal when at least one of said terminal units produces a signal;

a first counting means connected to said first OR means for initiating a counting operation at a predetermined rate when said first OR means produces a signal and for resetting said counting operation when the count reaches the number of said plurality of terminal units;

a plurality of AND means, each having a first input connected to a corresponding one of said plurality of terminal units and second and third inputs, for producing an output when each of said first, second and third inputs receive a signal;

a plurality of flip-flop circuits, each connected to a corresponding one of said plurality of AND means, for applying a signal to said second input of said corresponding AND means after being namually reset and for applying no signal to said second input of said corresponding AND means after said corresponding AND means produces an output, whereby said corresponding AND means is inhibited from producing an output after having once produced an output until said flip-flop circuit is manually reset;

a first decoder means connected to said first counting means and said third inputs of said plurality of AND means, for applying a signal to said third input of the one of said plurality of AND means which corresponds to the count of said first counting means, whereby said AND means produces an output only when the count of said first counting means corresponds to said AND means;

a second OR means connected to said plurality of AND means for producing a signal when one of said plurality of AND means produces a signal;

a second counting means connected to said second OR means for counting the number of times said second OR means produces a signal;

a plurality of memory means, each having a memory storage input means connected to said first counting means, a memory storage output means, a storage enable input and a recall enable input, for storing therein said count of said first counting means upon application of a signal to said storage enable input and for producing a signal corresponding to said number stored therein from said memory storage output means upon application of a signal to said recall enable input;

a second decoder means connected to said second counting means and said plurality of memory means, for applying a signal to said storage enable input of the one of said plurality of memory means corresponding to the count of said second counting means upon the count operation of said second counting means, whereby the count of said first counting means is stored in said memory means corresponding to the count of said second counting means;

a third counting means for counting under manual control and for resetting said counting operation when the count reaches the number of said plurality of terminal units;

a third decoder means connected to said third counting means and said plurality of memory means, for applying a signal to said recall enable input of the one of said plurality of memory means corresponding to said the count of said third counting means;

a first display means connected to said third counting means for producing a display corresponding to the count of said third counting means; and a second display means connected to said memory storage output means of said plurality of memory means for producing a display corresponding to the number stored in said memory means having said third decoder means applying a signal to said recall enable input thereof.

* * * * *